United States Patent [19]

Bernstein

[11] Patent Number: 4,996,509

[45] Date of Patent: Feb. 26, 1991

[54] MOLDED CAPLESS FUSE

[76] Inventor: Elliot Bernstein, Ridge Rd., Glen Cove, N.Y. 11542

[21] Appl. No.: 398,616

[22] Filed: Aug. 25, 1989

[51] Int. Cl.[5] ..... H01H 85/16

[52] U.S. Cl. ..... 337/232; 337/248; 337/252

[58] Field of Search ..... 337/231, 232, 233, 234, 337/235, 236, 237, 246, 248, 251, 252

[56] References Cited

U.S. PATENT DOCUMENTS 4,540,969 9/1985 Sugar ..... 337/232

4,749,980 6/1988 Morrill, Jr. et al. ..... 337/232

*Primary Examiner*—H. Broome

*Attorney, Agent, or Firm*—Ostrolenk, Faber, Gerb & Soffen

[57] ABSTRACT

A miniature end capless fuse comprises a nonconductive sleeve with a fusible element extending through it and leads to the ends of the fuse wire. Each electric lead to the fuse wire includes a deformed region near its end, but located outside the sleeve, for being held by insulating material applied over the entire fuse. The deformed region may be an enlargement at the end which does not extend into the sleeve but is attached to the end of the sleeve. It may alternately be a notch formed in the lead. The sleeve ends are metallized, the fusible element ends are soldered to the ends of the sleeve and the leads near their deformed regions are soldered to the ends of the sleeve, forming the fuse. The entire fuse is covered with a strengthening covering, e.g., a molded covering, which securely holds the leads to the sleeve by their deformed regions, e.g. their enlargements or notches.

14 Claims, 1 Drawing Sheet

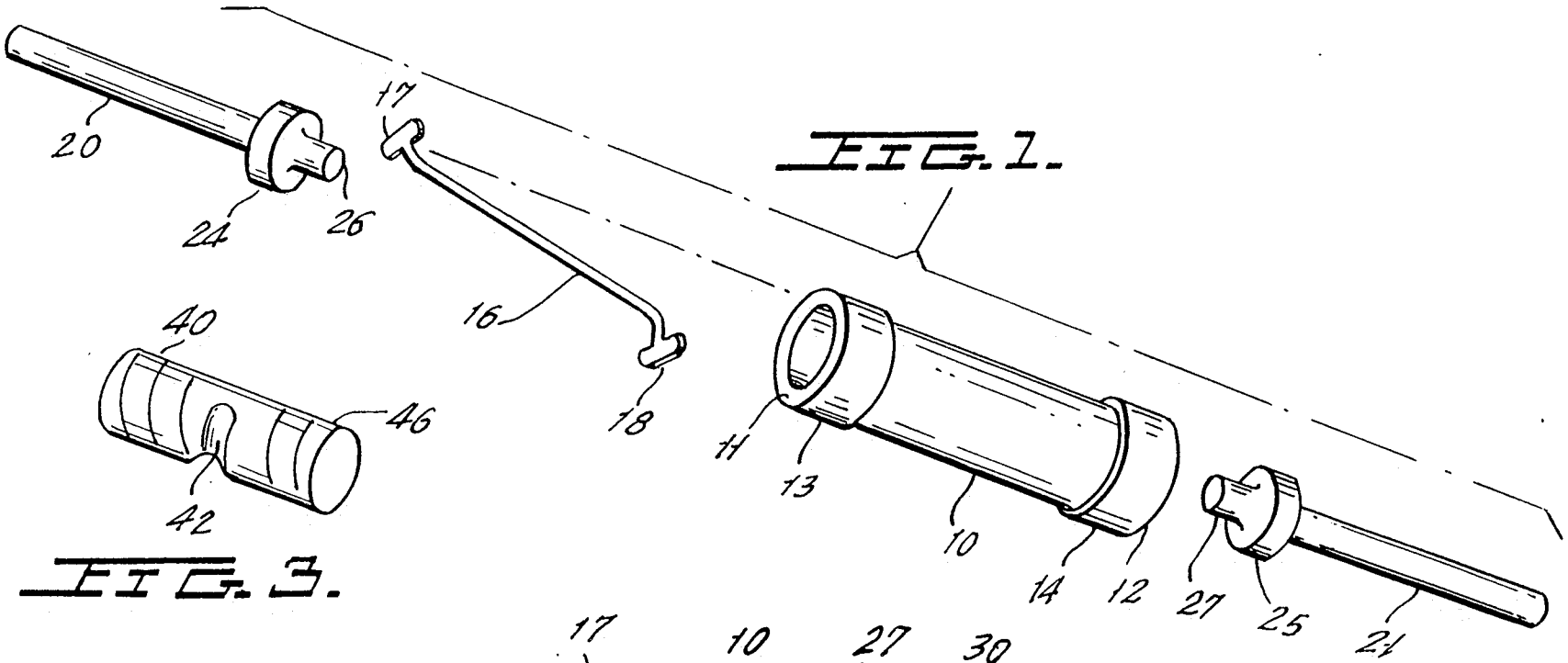
FIG. 1.
FIG. 3.
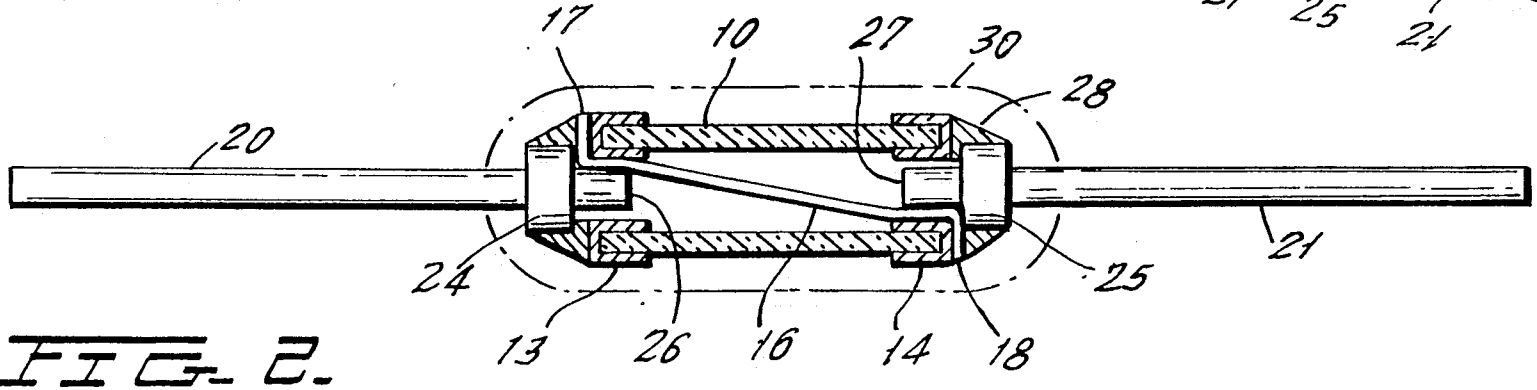
FIG. 2.

MOLDED CAPLESS FUSE

BACKGROUND OF THE INVENTION

The present invention relates to miniature electric fuses, useful in many electrical apparatus such as televisions, computers and the like. The invention particularly relates to the connection of the lead wires to the body of the fuse and more particularly is directed to an end capless fuse.

Known miniature fuses typically comprise a gas pressure resistant, hollow, open ended, insulating sleeve, which might be of glass, ceramic, or other electrically non-conductive material. A fusible element, adapted to melt on electrical overload, extends through the sleeve and is electrically connected to end caps that are affixed at the ends of the sleeve or to leads ending at the end caps. The electric leads to the fuse are either attached to the end caps and through those end caps to the fusible element in the sleeve, or the leads extend through the end caps to the fusible element.

Examples of a miniature fuse with end caps are seen in U.S. Pat. Nos. 4,746,784 and 4,540,969. An example of a lead wire which is connected to a fuse is found in U.S. Pat. No. 2,916,587. An unusual end cap arrangement is shown in U.S. Pat. No. 4,532,489.

When the electric circuit in which the fuse is connected suffers an electric overload, the fuse wire melts and perhaps vaporizes, solder inside the fuse sleeve may do the same, solder flux may vaporize and the gas or air in the fuse becomes heated. The gas pressure inside the fuse sleeve increases and rapidly. The temperature, particularly of a short circuit, may be high enough to soften the solder, weakening its hold on the leads. The gas pressure may apply enough pressure to the end caps and/or to the leads at the end caps to blow them out of the sleeve.

Often the assembled miniature fuses are encapsulated in a covering material. This material will block or at least inhibit the blowing out of the leads and end caps. Typically, it also serves as electric insulation of the covered elements. For example, in one technique known for years, miniature fuses are placed in a mold, and molding material is transfer molded around them. Transfer molding materials, which typically are known molding epoxies, are formulated so that they will not adhere to the metal end caps or to the leads or even to the nonconductive sleeve around the fuse wire. Such molding material therefore will not prevent a lead to a fuse and sometimes even the end cap on the fuse sleeve from blowing out of the covering material where elevated pressure developing in the sleeve, unless the fuse is so designed to permit the molding material to flow around an angle or a projection or into an undercut or notch. It is known that typically non-adherent molding materials, which are molded around a lead, will not hold the lead against moving through the molding material unless there is a knurl, notch, upset, enlargement, crimp, or a like misshapen section, formed in the lead, so that the molding material can flow into or around that section of the lead and lock onto the lead when the molding material cures.

Miniature fuses are intended to be extremely simple in structure and inexpensive to manufacture. One way to accomplish these objectives is to make the miniature fuse end capless. In such a fuse, the lead is soldered directly to the ceramic or glass sleeve of the fuse. An arrangement of a lead attached directly to a fuse wire is shown in Japanese Patent Publication Nos. 53 35144 and 52 22750. For enabling attachment of the leads, the ceramic sleeve may be metallized, which substantially is plating, at both of its ends, to enable the leads to be soldered to the metallizations and also to enable the ends of the fuse wire to be soldered to the metallizations. Then the assembled soldered fuse is placed in a mold and molding material is molded around both the leads and the sleeve. If each lead is simply a straight wire or is a stiff pin extending from the end of a lead and to the fuse, the lead is held in place at the sleeve only by the strength of the solder joint between the lead and the metallized ceramic. Temperature, or outward pushing forces caused by overload or short circuit conditions, or physical pulling on leads during installation, can weaken or melt the solder joints so that the leads can be easily pulled out or can be blown out of the fuse assembly. Some effective means is needed to provide a capless fuse wherein the lead is securely held to the fuse sleeve rather than to an end cap over the sleeve.

SUMMARY OF THE INVENTION

Accordingly, the primary object of the present invention to provide an easily fabricated, inexpensive, simple construction miniature electric fuse.

It is another object of the present invention to provide an end capless fuse wherein the fuse leads are securely held to the fuse body.

A further object of the invention is to enable more secure attachment of the fuse leads to the fuse body where the entire fuse is encapsulated and particularly where it is a molded encapsulation.

According to the invention, the miniature fuse includes a non-conductive material, sleeve shaped fuse body. The opposite ends of the non-conductive material sleeve are metallized or otherwise provided with a metallic surface which covers the ends of the sleeve and coats both the exterior and interior of the sleeve at and a distance axially in from the ends. The fusible element extends through the sleeve and is arranged so that its ends lie adjacent to the metallized ends of the sleeve. The ends of the fusible element are fastened by soldering, or the like, to the metallizations or to the fuse leads in the usual manner.

The invention particularly relates to the structure of the leads and to the manner of attaching the leads to the fuse. The leads in the form of wires or lead pins are normally relatively thin in diameter at the fuse and are of uniform smooth cross section. But, at the end section of the lead, approximately where the lead is to be joined or soldered to the ceramic sleeve, the lead wire or pin is deformed e.g. thickened, thinned, twisted in shape, as by crimping, compressing, notching, upsetting, or otherwise deforming the lead near or at the end of the lead which is toward the fuse sleeve to expand or contract and more generally deform the cross section of the lead. In one preferred embodiment, the lead is enlarged at its end region just outside the fuse sleeve to approximately as large as the diameter or cross section of the opening into the fuse sleeve. In another embodiment, a notch is formed in the lead by crimping the lead. Then the lead is soldered to the metallized end of the sleeve with the enlargement on the lead, the notch in the lead or the other deformity of the lead disposed outside of but generally at the respective end of the sleeve. The solder flows around the lead, the fuse wire and the ceramic sleeve securing them together. Regardless of the shape of the lead end section where it is secured at the end of the sleeve, the open end of the fuse sleeve must be sealed. Solder placed around the lead at the sleeve will complete the seal of the sleeve around the lead.

Ideally, an enlargement or upset end portion of the lead is a circular enlargement at least approximately as large as the end opening in the fuse sleeve so that it can be disposed at the end of the sleeve and make contact all around it. In practice, for example if the enlargement is achieved by crimping the lead, it may be enlarged to be greater in cross-section than one of the diameters of the sleeve but not extending all around the sleeve. Regardless of the shape of the lead at the sleeve, an enlargement should have sufficient contact with the sleeve for accomplishing the objectives of the invention.

The invention further concerns applying the covering, which may particularly be of a molding material applied by transfer molding, over the sleeve and over the enlargement, notch or other deformity in the lead. While the covering molding material may not adhere to the lead, it will wrap around or move into the deformity. When the covering material has set, the covering will hold securely to the lead and secure the lead to the sleeve. This will prevent the lead from blowing out or separating from the sleeve.

The foregoing and other objects and features of the invention are described below with reference to the accompanying drawings.

BRIEF DESCRIPTION OF THE DRAWINGS

FIG. 1 is an exploded view showing the elements of which a fuse of the invention is comprised, including the sleeve, the fusible element and the leads with enlarged end portions, but before application of a covering;

FIG. 2 is a cross sectional view of the fuse assembled and in a molded covering;

FIG. 3 shows an alternate design of a lead for the fuse.

DESCRIPTION OF THE PREFERRED EMBODIMENT

Referring to the drawings, the miniature fuse of the present invention is comprised of a hollow sleeve or tube 10, preferably comprised of ceramic material, but possibly of glass or other electrically non-conductive, gas pressure resistant material. The sleeve is open at its ends 11 and 12. Those ends are metallized by appropriate deposits, e.g. plated deposits, of solderable, electrically conductive metal which define metallized end regions 13 and 14 on the sleeve. Each metallized region is on a respective end of the sleeve and may wrap around the outside of the sleeve near the end and may extend into the sleeve near the end. The metallized regions 13 and 14 are spaced apart along the sleeve so that there is no electrical connection between them other than the below described fuse wire 16.

A fusible element 16 extends through the hollow of the sleeve 10 and the ends 17 and 18 of the fuse wire extend over the metallized ends 11 and 12 of the sleeve to be soldered in place there along with each of the leads, as described below. The end sections 17 and 18 of the fusible element 16 may be flattened to define a greater contact area for attachment to the metallized ends 11 and 12. Alternatively, those ends of the fusible element may be long enough to fold around the ends of the sleeve, where they are thereafter soldered.

The fusible element 16 is supplied with electricity through the leads 20 and 21. The leads extend to the opposite respective ends 11 and 12 of the sleeve 10 where they are fastened. The stub ends of the leads may extend a short distance into the sleeve. The leads 20 and 21 are soldered in place at the respective ends of the sleeve. But, as noted in the discussion of the prior art, the soldered connection of the end portion of a lead to the sleeve may not itself be sufficient to hold the lead to the sleeve without further strengthening of the connection.

The leads 20 and 21 are of a relatively smaller diameter and may be as small in cross-section or diameter as or even smaller than the opening into the end of the sleeve 10. For strengthening the connections between the lead wires or pins 20 and 21 and the ends of the sleeve after the below described covering 30 is applied, the end portions of the leads, at or near their ends, are enlarged, as by crimping, or pressure application on the end of the lead wire or pin to develop an enlargement, upset or bulge 24, 25 at the end portion of each lead 20 and 21, respectively. The diameter or at least one diameter, e.g. of a wire squeezed flat, of each enlargement 24 and 25 could even be greater than the diameter of the respective opening into the sleeve 10, but it is likely to be no greater in size in any dimension than the opening into the sleeve, and possibly smaller.

It is important for fuse function that the ends of the sleeve 10 be sealed closed. To the extent that the enlargements 24 and 25 do not seal around the entire circumference of the ends of the sleeve 10, any slight gaps between the lead and the sleeve around the circumference are sealed closed by the solder when the lead is soldered to the sleeve. There may be short stubs 26 and 27 of the lead wires which extend into the sleeve past the enlargements. For the functioning of the invention, the enlargements 24 and 25 must have at least their axially outward surface, if not more, or perhaps their entire body out of the sleeve, to be engaged by the later applied covering.

A solder paste, solder wire or solder coating 28 to be melted by subsequent vapor phase or other suitable soldering method is applied to the metallized ends 11 and 12 of the sleeve, coating over and holding the enlargements 24 and 25 of the leads at the metallized ends of the sleeve. Then the assembled unit is soldered by a soldering process, which integrates the lead enlargements with the ends of the sleeve 10 and secures the ends of the fusible element in place as well forming a sturdy fuse assembly, as compared with soldered leads in the prior art. This fuse is ready for installation and may be used in this form. However, it has not yet been coated to mechanically strengthen it, which may make the fuse construction undesirable for numerous applications. Furthermore, its fuse leads still are not well protected against blowing out of the sleeve under elevated gas pressure in the sleeve.

For strengthening the fuse structure and engaging its fuse leads to prevent their separation from the sleeve, the fuse is placed in the cavity of a mold (not shown), such as an injection mold, and then the entire fuse is molded over with a molding material, such as epoxy. The previously sealed sleeve 10 is not invaded by any of the molding material, whereby the earlier sealing of the sleeve before molding is important. The molding epoxy molds around the sleeve, around the leads and around the enlargements of the leads forming the molded covering 30. Further, because the leads include the integral enlargements 24, 25, the molding compound wrapping around the enlargements holds the enlargements and the leads securely to the sleeve 10, ensuring integration of the elements of the fuse and preventing the fuse leads from separating from the fuse sleeve upon occurrence of an overload which can generate high temperature and elevated gas pressure in the sleeve, or during installation of the fuse, or due to the heating of the fuse which may occur when it is soldered into a circuit, or any damage to the fuse when stress is applied to the leads in use.

FIG. 3 shows the terminal end portion of a lead of an alternate embodiment of the invention, where the lead 40 includes an indented notch 42, formed at one side, e.g. by crimping. A stub 46 projects beyond the notches 42. The lead is inserted a short distance into the fuse sleeve, like sleeve 10, with the stub 46 leading. The lead is placed so that the notch 42 is outside the end of the sleeve to receive molding epoxy. Then the lead is soldered in place at the sleeve. Subsequently, the fuse sleeve and the leads at the notches are molded over by molding epoxy, as in the first embodiment. The notches are another example of a deformation of the lead which enables molding epoxy to mold into the notches and hold securely to the lead. This prevents extraction or blowing out of the lead even though the molding material is non-adherent to the leads.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A capless electric fuse comprising:

an electrically non-conductive, hollow sleeve, the sleeve having opposite ends; at least one of the ends of the sleeve being metallized;

a fusible element extending through the sleeve and having a length so as to have first and second ends which are engageable with the ends of the sleeve;

a respective lead for attachment to the metallized end of the sleeve, said lead having an end portion, and the lead being attached to the respective metallized end in the vicinity of the end portion of the lead; and the end portion of the lead, the respective first end of the fusible element, and the respective metallized end of the sleeve being soldered together, said lead and said first end of said fusible element being secured to each other and to said metallized end of said sleeve by said soldering, no end cap being present on the sleeve.

2. An electric fuse comprising:

an electrically non-conductive, hollow sleeve, the sleeve having opposite ends; at least one of the ends of the sleeve being metallized;

a fusible element extending through the sleeve and having a length so as to have first and second ends which are engageable with the ends of the sleeve;

a respective lead for attachment to the metallized end of the sleeve, said lead having an end portion, and the lead being attached to the respective metallized end in the vicinity of the end portion of the lead; at the end portion, the lead being deformed in cross-section with respect to the remainder of the lead, defining a deformed region of the end portion, which is disposed at least in part outside the sleeve and thereby engageable by a covering layer to be applied over the deformed region and over at least the metallized end of the sleeve; and the end portion of the lead, the respective first end of the fusible element, and the respective metallized end of the sleeve being soldered together;

and further comprising a strengthening covering for the fuse, extending over the sleeve and over the deformed region of the lead, further mechanically strengthening the fuse and also engaging the deformed region and aiding in holding the soldered lead to the sleeve.

3. The fuse of claim 2, wherein both of the ends of the sleeve are metallized; and a respective lead being provided for attachment to each metallized end of the sleeve.

4. The fuse of claim 3, wherein the sleeves have end regions extending in from the ends, the end regions being metallized and the metallized end regions of the sleeve being spaced apart.

5. The fuse of claim 3, wherein each of the leads to each of the respective metallized ends of the sleeve has a respective one of the deformed regions, and the end portions of the leads are soldered to the respective metallized ends of the sleeve; and the strengthening covering extend over the entire fuse including the deformed regions of both of the leads for engaging the deformed regions for aiding in holding the respective soldered leads to the sleeve.

6. The fuse of claim 5, wherein the strengthening covering is of molding material.

7. The fuse of claim 2, wherein the deformed region comprises an enlargement of the cross-section of the lead with respect to the rest of the end portion of the lead.

8. The fuse of claim 7, wherein the enlargement is an integral one piece part of the lead.

9. The fuse of claim 7, wherein the enlargement is so shaped and of a size such that it engages the end of the sleeve where it is soldered.

10. The fuse of claim 9, wherein the enlargement is of such a shape in cooperation with the respective metallized end of the sleeve that the solder applied at the end of the sleeve cooperates for sealing the end of the sleeve against entry of materials therein after the enlargement has been soldered to the respective metallized end of the sleeve.

11. The fuse of claim 10, wherein the enlargement is defined on the lead so as to be spaced a short distance from the end of the lead.

12. The fuse of claim 2, wherein the deformed region comprises a notch defined in the lead, narrowing the width of the lead and shaped for receiving molding material therein.

13. The fuse of claim 12, wherein the notch is spaced a short distance from the end of the lead.

14. The fuse of claim 10, wherein the enlargement is substantially coextensive with an end opening in the sleeve.

* * * * *